United States Patent [19]

Dulat

[11] 4,289,637

[45] Sep. 15, 1981

[54] MINERAL OIL SOLUBLE BORATE COMPOSITIONS

[75] Inventor: Joseph Dulat, Fetcham, England

[73] Assignee: United States Borax & Chemical Corp., Los Angeles, Calif.

[21] Appl. No.: 98,455

[22] Filed: Nov. 29, 1979

[30] Foreign Application Priority Data

Jan. 15, 1980 [GB] United Kingdom ..... 47564/78

[51] Int. Cl.[3] ..... C10M 1/06

[52] U.S. Cl. ..... 252/49.5; 252/49.6

[58] Field of Search ..... 252/18, 42.1, 49.5, 252/49.6

[56] References Cited

U.S. PATENT DOCUMENTS

| | | | |
|---|---|---|---|
| 173,840 | 2/1876 | Winsor | 252/18 |
| 263,911 | 9/1882 | Inman | 252/18 |
| 1,246,869 | 11/1917 | Burch | 252/49.5 X |
| 2,430,400 | 11/1947 | Hoelscher | 252/49.5 |
| 2,753,304 | 7/1956 | Orozco | 252/18 |
| 3,065,174 | 11/1962 | Blake et al. | 252/49.5 X |
| 3,278,430 | 10/1966 | Williams | 252/42.1 X |
| 3,313,727 | 4/1967 | Peeler | 252/18 |
| 3,313,729 | 4/1967 | Glasson | 252/18 |
| 3,833,502 | 9/1974 | Leary et al. | 252/42.1 X |
| 4,138,348 | 2/1979 | Grasshoff | 252/49.5 X |

OTHER PUBLICATIONS

Kirk-Othmer, "Encyclopedia of Chemical Technology", 2nd Edition, vol. 19, pp. 512-514, 1969.

*Primary Examiner*—Andrew Metz

*Attorney, Agent, or Firm*—James R. Thornton

[57] ABSTRACT

Alkali metal borates are reacted with fatty acids or oils in the presence of a low HLB value surfactant to give a stable, mineral oil-soluble product. Mineral oil containing the borate can be used as a cutting fluid.

11 Claims, No Drawings

MINERAL OIL SOLUBLE BORATE COMPOSITIONS

This invention relates to alkali metal borate-fatty acid reaction products which are soluble in mineral oils.

BACKGROUND OF THE INVENTION

In the field of lubrication, cutting fluids are typically made from mineral oils and contain emulsifying materials which enable stable aqueous emulsions to be produced. In practice, cutting fluid emulsions are subjected to biodegradation as they are ideal breeding grounds for bacteria. The presence of bacteria is very troublesome as it can lead to breakdown of cutting fluid emulsions, corrosion of machined parts and shortened tool life as well as being a potential health hazard. It is therefore important that cutting fluid emulsions should contain corrosion inhibitors and biocides to inhibit or prevent bacterial growth. This may be achieved by regular addition of biocides to cutting fluid emulsion, but it is preferable that cutting fluids, as supplied by the manufacturers, contain biocidal materials.

Boron compounds, particularly alkali metal borates, are known to be both corrosion inhibitors and effective biocides. Various proposals have been made to incorporate boron compounds into lubricants as they are known to have important lubricating properties as well as being corrosion inhibitors and biocides. However, the use of alkali metal borates for these applications, although attractive, is accompanied by the inherent difficulty of preparing a suitable dispersion of an inorganic salt in a mineral oil. Therefore, an effective and economical way of solubilizing an alkali metal borate in a mineral oil is desirable.

U.S. Pat. No. 3,853,772 describes a lubricating oil containing a dispersion of alkali metal borate. British Pat. No. 1,306,211 describes the preparation of oil additives by reaction of boric acid with a surfactant in the presence of a metal alcoholate.

DESCRIPTION OF THE INVENTION

This invention provides a method for the preparation of an alkali metal borate reaction product which is soluble in mineral oils which comprises reacting a hot aqueous solution of an alkali metal borate with a fatty oil or a fatty acid or a mixture thereof at an elevated temperature in the presence of a surfactant having a low hydrophilic-lipophilic balance value.

The invention also provides the resulting alkali metal borate reaction product which has the appearance of a cream or soft solid emulsion and which does not separate on storage.

The reaction products of this invention are readily solubilized in mineral oils which have as additives a surfactant or mixture of surfactants which, when blended, has an intermediate to high hydrophilic-lipophilic balance value. Thus, according to another aspect, the invention provides a method of preparing a mineral oil containing an alkali metal borate which comprises reacting a hot aqueous solution of an alkali metal borate with a fatty oil or a fatty acid or a mixture thereof at an elevated temperature in the presence of a surfactant having a low hydrophilic-lipophilic balance value and mixing the resulting reaction product with a mineral oil containing at least one surfactant having an intermediate to high hydrophilic-lipophilic balance value.

The hydrophilic-lipophilic balance (HLB) of surfactants is an expression of the relative simultaneous attraction of a surfactant for the two phases of an emulsion system. An emulsifying surfactant that is lipophilic in character is assigned a low HLB value and an emulsifying surfactant that is hydrophilic in character is assigned a high HLB value. Thus, emulsifying surfactants that have a low HLB value will tend to make water-in-oil emulsions.

HLB is measured on a scale 0–20, with a few values higher than 20. If a particular surfactant has an HLB value below 9, it is considered low, and if the HLB value is above 11, it is considered high. Surfactants of intermediate values have HLB values of between 9 and 11.

It has been found that surfactants having an HLB value of less than 5 are preferred for manufacturing the stable alkali metal borate reaction products in accordance with this invention. Particularly preferred surfactants having low HLB values included beeswax, lanolin and ethylene glycol monostearate, although other commercially available materials having the desired HLB, for example, materials based on condensates of fatty acids with ethylene glycol or diethylene glycol, are equally satisfactory. See McCutcheon's *Detergents & Emulsifiers,* 1977 Annual, pages 9–27 for a list of surfactants and their HLB values. The surfactant can be a combination of two or more surfactants described in the foregoing. Mixtures which include surfactants having an HLB greater than 9, may also be used with the proviso the blend has an HLB value less than 9, and preferably less than 5.

The surfactant having a low HLB value is preferably dissolved in the fatty acid or oil or mixture thereof before adding the borate solution. The quantity of surfactant which is used is variable based on the particular surfactant selected and fatty acid or oil employed, but it is preferably between about 1% and 10% by weight based on the alkali metal borate reaction product.

Suitable fatty acids are the oil-soluble carboxylic acids containing about 8–22 carbon atoms, such as oleic acid, stearic acid, palmitic acid, 2-ethylhexoic acid and linoleic acid. Fatty oils may be used as sources of fatty acids. The preferred fatty oils are vegetable oils which include tall oil, coconut oil, palm oil, olive oil, castor oil and peanut oil.

The alkali metal borates which may be used include alkali metal metaborates, tetraborates and higher borates such as POLYBOR ® (disodium octaborate tetrahydrate). The preferred alkali metals are potassium and, especially, sodium. Precursors of alkali metal borates are intended to be included within the scope of the term alkali metal borates. For example, mixtures of an alkali metal hydroxide with boric acid or boric oxide may be used, thereby forming metal borate in situ.

The reaction takes place at a temperature in the range of about 50° to 120° C., preferably at about 70° to 100° C. It is preferred that the alkali metal borate solution used in the reaction is concentrated.

In a preferred embodiment of the invention, the stable reaction products contain about 5–30 percent w/v of alkali metal borate.

For effective control of bacteria, a cutting fluid emulsion should contain at least about 1000 ppm. of alkali metal borate. It is therefore preferable that a cutting fluid should contain at least 1% w/v, preferably about 1 to 10% w/v, of alkali metal borate prior to dilution with water (for example, in a ratio of 1:10 to 1:40) according to the cutting operation required. These concentrations of borate can be readily achieved using the compositions of the invention.

It is important in cutting operations that stable foams are not produced. An advantage of the cutting fluids containing the products of this invention is that any foams produced during use quickly collapse.

The invention is further illustrated by the following examples.

EXAMPLE 1

50 ml. of tall oil were placed in a 250 ml. vessel and 2 g. of beeswax were added. The resulting mixture was stirred and heated to 75° C. A solution of 10 g. of borax (sodium tetraborate decahydrate) dissolved in 35 ml. of distilled water, was heated to 75° C. and added slowly to the tall oil/beeswax solution maintained at 75° C. Stirring was continued until a homogeneous cream was produced, and the mixture was then allowed to cool.

The resulting product was a viscous, homogeneous cream which did not separate on standing.

EXAMPLES 2–10

The procedure followed was substantially the same as in Example 1 but different fatty acids and/or surfactants were used as indicated in Table 1 which shows the compositions and appearance of the products obtained.

TABLE I

| Example | Composition 10 g. of borax + | Appearance and stability of product on storage |
|---|---|---|
| 2 | 10 g. beeswax in tall oil | Soft non-crystalline solid. Stable. |
| 3 | 1 g. beeswax in tall oil | Viscous cream. Stable. |
| 4 | 4 g. lanolin in tall oil | Viscous cream. Stable.** |
| 5 | 3 g. lanolin in tall oil | Viscous cream. Stable.** |
| 6 | 2 g. lanolin in tall oil | Viscous cream. Stable.** |
| 7 | 1 g. beeswax in oleic acid | Viscous cream. Stable. |
| 8 | 3 g. lanolin in oleic acid | Viscous cream. Stable. |
| 9 | 2 g. lanolin in oleic acid | Viscous cream. Stable. |
| 10 | 10 g. ethylene glycol monostearate in tall oil | Viscous cream. Stable. |

**Stability was improved by re-mixing the products by stirring after cooling.

The products of the invention may be dispersed in mineral oils containing surfactants with HLB values of 10–12 by known methods such as mechanical shaking. The effectiveness of the dispersal of some of the products of the examples is given in the following Table II.

TABLE II

| Example | Wt. product used per 100 ml. mineral oil | Effectiveness of dispersal |
|---|---|---|
| 3 | 5 g. | Complete dispersal and solubilization |
| 6 | 5 g. | Complete dispersal and solubilization |
| 8 | 5 g. | Complete dispersal and solubilization |

TABLE II-continued

| Example | Wt. product used per 100 ml. mineral oil | Effectiveness of dispersal |
|---|---|---|
| 9 | 5 g. | Complete dispersal and solubilization |
| 3 | 10 g. | Complete dispersal and solubilization |
| 9 | 10 g. | Complete dispersal and solubilization |

Various changes and modifications of the invention can be made, and to the extent that such variations incorporate the spirit of this invention, they are intended to be included within the scope of the appended claims.

What is claimed is:

1. A stable, mineral oil-soluble borate composition formed by reacting at a temperature in the range of about 50° to 120° C. an aqueous solution of an alkali metal borate with a fatty acid containing about 8–22 carbon atoms, fatty oil containing said fatty acid, or mixture thereof in the presence of about 1 to 10% of a surfactant selected from lanolin, ethylene glycol monostearate, and mixtures hereof, said composition containing about 5–30% of said alkali metal borate.

2. A composition according to claim 1 in which said surfactant is lanolin.

3. A composition according to claim 1 in which said alkali metal borate is borax.

4. A method for the preparation of an alkali metal borate reaction product which is soluble in mineral oil which comprises reacting an aqueous solution of an alkali metal borate with a fatty acid containing about 8–22 carbon atoms, a fatty oil containing said fatty acid, or a mixture thereof, at an elevated temperature in the range of about 50°–120° C. in the presence of about 1 to 10% of a surfactant selected from lanolin, ethylene glycol monostearate, and mixtures thereof, said reaction product containing about 5 to 30% w/v of said alkali metal borate.

5. A method according to claim 4, wherein the surfactant is lanolin.

6. A method according to claim 4, wherein the fatty oil is tall oil, coconut oil, palm oil, olive oil, castor oil or peanut oil.

7. A method according to claim 4, wherein the alkali metal borate is a sodium or potassium borate.

8. A method according to claim 4, wherein the surfactant is dissolved in the fatty acid, fatty oil or mixture thereof and wherein the alkali metal borate solution is subsequently added.

9. A method according to claim 4, wherein the alkali metal borate is borax.

10. A method according to claim 4 wherein said aqueous solution is a hot concentrated solution of alkali metal borate and said elevated temperature is in the range of about 70° to 100° C.

11. Mineral oil containing the borate composition of claim 1 dissolved therein, said mineral oil containing at least one surfactant having an intermediate to high HLB value and containing about 1 to 10% w/v of alkali metal borate.

* * * * *

UNITED STATES PATENT OFFICE
CERTIFICATE OF CORRECTION

Patent No. 4,289,637 Dated Sept. 15, 1981

Inventor(s) Joseph Dulat

It is certified that error appears in the above-identified patent and that said Letters Patent are hereby corrected as shown below:

Item [30] should read -- Dec. 7, 1978 [GB] United Kingdom ..... 47564/78

Column 1, line 12, the word "subjected" should read -- subject --.

Signed and Sealed this

Fifth Day of January 1982

[SEAL]

Attest:

GERALD J. MOSSINGHOFF

Attesting Officer

Commissioner of Patents and Trademarks